US006561832B2

(12) United States Patent
Geltsch et al.

(10) Patent No.: US 6,561,832 B2
(45) Date of Patent: May 13, 2003

(54) ELASTIC HOLE ADJUSTABLE SPRING CONNECTOR

(75) Inventors: Hans-Otto Geltsch, Rohr (DE); Rainer Schmidt, Nuremberg (DE)

(73) Assignee: Framatome Connectors International, Courbevo (FR)

( * ) Notice: Subject to any disclaimer, the term of this patent is extended or adjusted under 35 U.S.C. 154(b) by 0 days.

(21) Appl. No.: 09/813,263

(22) Filed: Mar. 20, 2001

(65) Prior Publication Data

US 2001/0024899 A1 Sep. 27, 2001

(30) Foreign Application Priority Data

Mar. 21, 2000 (DE) ..... 100 13 823

(51) Int. Cl.[7] ..... H01R 4/50
(52) U.S. Cl. ..... 439/345; 439/353
(58) Field of Search ..... 439/353, 352, 439/350, 345, 595, 816, 820, 832

(56) References Cited

U.S. PATENT DOCUMENTS 4,601,528 A * 7/1986 Spier ..... 439/352
4,655,527 A * 4/1987 Vandame ..... 439/350
5,439,387 A * 8/1995 Hayashi et al. ..... 439/345

FOREIGN PATENT DOCUMENTS

EP 0945927 A2 9/1999

* cited by examiner

*Primary Examiner*—P. Austin Bradley
*Assistant Examiner*—Briggitte R. Hammond
(74) *Attorney, Agent, or Firm*—Perman & Green, LLP

(57) ABSTRACT

An electrical connector plug comprising a connector housing (1) with at least a first locking element (7, 8, 44) that is rigid and a counter-connector housing (2) which is complementarily to the connector housing (1) with at least a second locking element that is resilient (15, 53) and a spring element (25,55) for increasing a spring force and together with the first and second locking elements (7, 8, 15, 44, 53) define an unstable swell point. Furthermore, during movement of the counter-connector housing (2) in the direction of insertion (F) into the connector housing (1), the first locking element (7, 8, 44) presses so strongly against the second locking element (15, 53), that the spring element (25, 55) located in the second locking element (15, 53) builds up a tension with the swell point being reached by using tension from the spring element (25, 55).

9 Claims, 4 Drawing Sheets

ELASTIC HOLE ADJUSTABLE SPRING CONNECTOR

BACKGROUND OF THE INVENTION

1. Field of the Invention

This invention relates to electrical connector plugs, and more particularly to an electrical connector plug including a connector housing which has at least a first locking element and a counter-connector housing which is formed complementarily to the connector housing, the connector housing having at least a second locking element with a spring element.

2. Description of the Prior Art

Such connector plugs have additional spring elements which are, for example, made from an elastomer, in order to increase the elasticity of the locking arms so that in the case of material fatigue of the locking arms, the connection between the connector housing and the counter-connector housing is not affected.

A generic connector plug according to EP 0 945 927 A2 has a body from which locking arms extend for the locking of the connector plug into the matching counter-connector. One pair of ends of the locking arms are formed on the body of the connector and coupled to the same, with the other ends of the locking arms also connected with the body through elastic spring elements. The said elastic spring elements yield, so that the other ends can be pressed together.

The connection of the locking arms with the body prevents the breaking off of the locking arms. Admittedly, this connector plug is not suitable for the go/no go principle, since it also allows undefined insertion positions.

By connector plug based on the go/no go principle is understood a connector plug, which must overcome a swell point during the process of insertion of the plug. If the fitter overcomes this swell point, the connector plug is automatically inserted into the counter-connector, that is to say in English, "go", because the connector plug "goes" into the counter-connector.

If the swell point is not overcome, the connector can either remain in position or be pushed back, that is to say, "no go" meaning that the connector does not "go" into the counter-connector, resulting in there being no electrical connection between the connector and the counter-connector.

It is possible to half-insert the connector into the counter-connector without its becoming properly locked in. In areas where a high degree of vibration occurs, such a connector plug can become loosened in time.

Connector plugs based on the go/no go principle make use of steel springs, since their spring strength is easily adjustable. Here it is a drawback that in the process of manufacture, the two housings are first injection-moulded and the steel springs must then be built into the said housing or housing. This accordingly requires a time—and cost—intensive additional manufacturing step.

SUMMARY OF THE INVENTION

It is the purpose of the present invention to make available an electrical connector plug in which the elasticity of the locking element of the connector plug can be adjusted easily and without any additional fitting effort.

A particularity of the invention resides in the fact that by a change of form, the dimensions and the construction material of the spring element, the elasticity of the locking element can easily be determined. The incorporation of a steel spring is no longer necessary, since the connector plug including the spring element can be made by a simple double injection moulding process.

It is an advantageous embodiment of the invention that the spring element has a pass-through hole located substantially in its centre, where by means of a change in the diameter of the said hole, it is possible to adjust the elasticity of the spring element.

BRIEF DESCRIPTION OF THE DRAWINGS

Further particularities and advantages of the invention will emerge from the following descriptions of embodiment examples which refer to the diagrammatic drawings where.

DESCRIPTION OF THE PREFERRED EMBODIMENT

Figure 1:
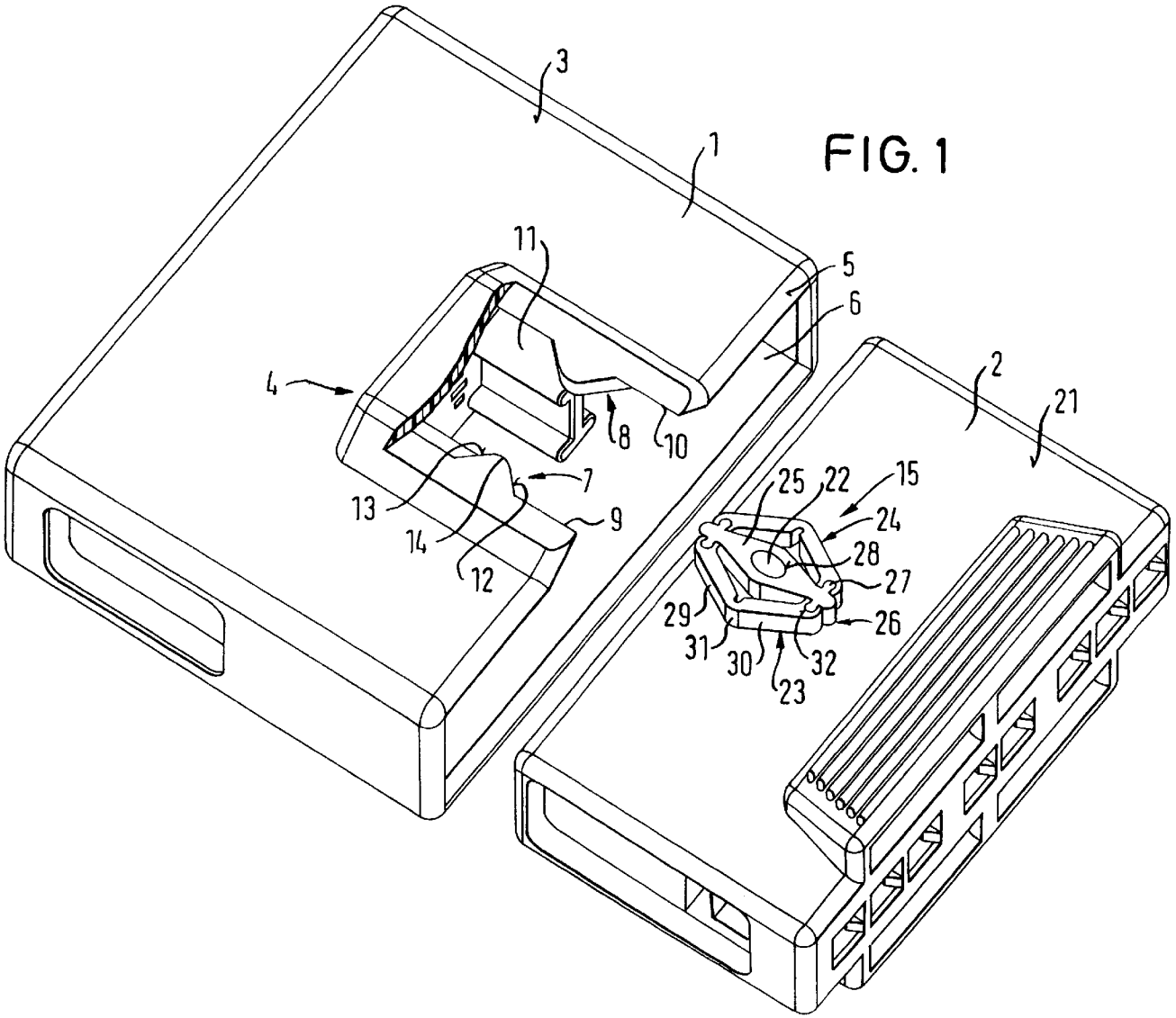
FIG. 1 is a perspective view of a first embodiment example of a connector plug with a pin socket shown partly cut away.

FIG. 1 shows a substantially rectangular connector plug with a connector housing 1 and a counter-connector housing 2 which is complementary thereto. On the upper face 3 of the connector housing 1 there is a formed-on trapezoidal projection 4, which is arranged centrally on the edge 5 of the connector opening 6. Inside the projection 4 are two locking lugs 7 and 8 lying opposite one another which are bound to the housing walls 9 and 10 and which, in turn, frame the recess 11. On the upper edge of the sliding rails are formed-on the locking lugs 7 and 8 which lie opposite facing one another and which are contained between diagonal ramps 12 and 13 which meet in a ridge 14. These locking lugs form the first locking elements of the connector housing.

The counter-connector housing 2 has in the centre of its upper face 21 the second locking element. This element is fastened by an oval pin 22 which is formed onto the housing. The second locking element has two angles 23 and 24 and a longish spring element 25. The spring element lies in the direction of insertion and both of its ends 26 are rosette-shaped, each being formed into three buds 27. In the centre of the spring element 25 is a hole 28, into which the pin 22 is introduced. In addition, each angle 23, 24 has two legs 29, 30 which are coupled to the tip 31 of either of the angles 23, 24. The free ends of the legs 29, 30 have recesses 32 complementarily formed to the buds 27 to receive the same. In this way, the spring element 25 forms a common base for the outward-buckled angles 23 and 24. In the tension-free position of the spring element 22 (as shown in FIG. 1) which can moreover consist of elastomer or rubber, the tips 31 of the angles 23, 24 are the furthest away from one another. In this position, the spring element is relatively short.

Below appears a brief description of the mode of functioning of this embodiment example.

Figure 2A:
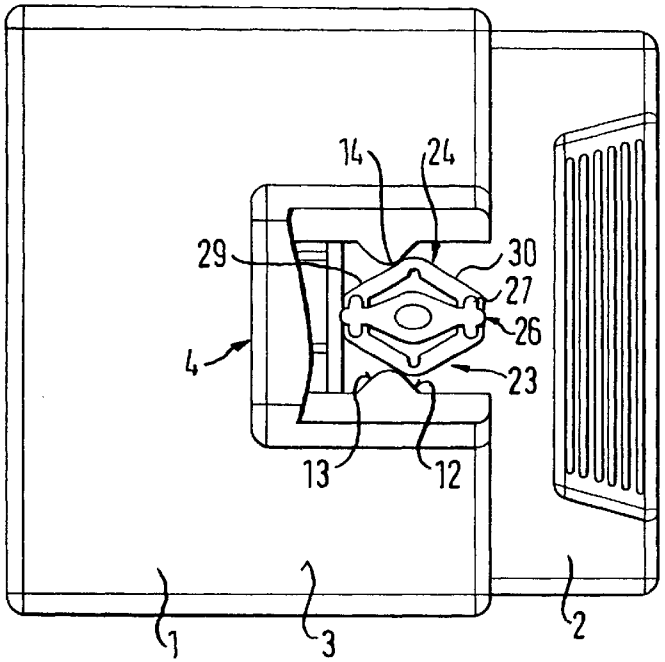
FIG. 2A is a plan view of the connector plug from FIG. 1 in its half-inserted position.

The user introduces the counter-connector 2 into the connector 1. The second locking element reaches into the recess 11 of the trapezoidal projection 4, as can be seen from FIG. 2A. Without any great effort, the counter-connector 2 is inserted until the ramps 12 of the locking lugs 7 and 8 touch one another.

Figure 2B:
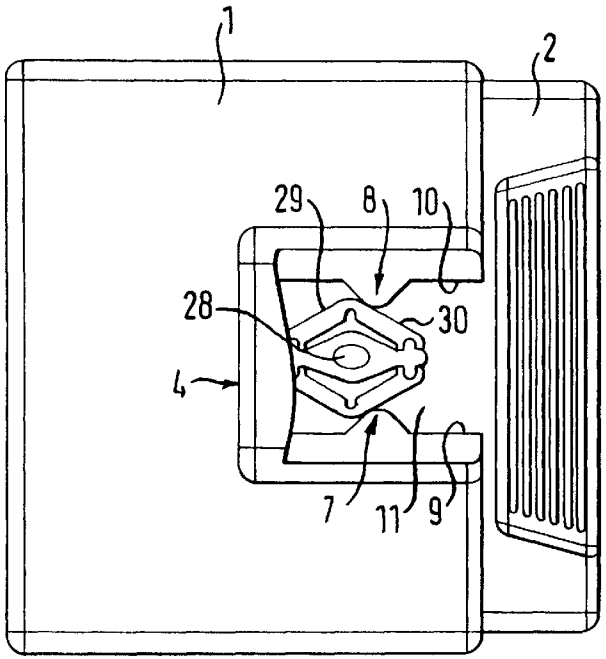
FIG. 2B is a plan view of the connector plug from FIG. 1 in its fully inserted position.

On continuing insertion of the counter-connector 2 it is necessary to overcome, in addition to the frictional forces generated by electrical contacts, also the spring strength of the spring element 25 ; during this process, the angles 23, 24 are pressed together and the spring element 25 is stretched. This builds up tension, the ridges 14 of the locking lugs 7 and 8 are overcome by the tips 31 of the angles 23, 24 and the tension which has built up in the spring element 25 is released. The legs 31 of the angles 23, 24 press on the ramps 13 of the locking lugs 7 and 8 and as can be seen from FIG. 2B, the counter-connector 2 is pressed fully into the connector 1. The first and second locking elements are arranged in such a way that the legs 30 and the ramps 13 in the inserted position press against one another and thereby exercise a protection from vibration, that is to say, a light force is continuously exerted on the counter-connector 2.

DESCRIPTION OF THE PREFERRED EMBODIMENTS

If the ridges 14 are not overcome by the tips 31, the tension which has built up in the spring element 25 is released, with the other leg 29 acting on the other ramp 12 so that the counter-connector 2 is forced out of the connector 1.

During the said process of forcing out, the same thing happens, because the build-up of tension is symmetrical. Accordingly, such connector plugs always provide a defined position, that is to say, either the counter-connector is in the connector, or the counter-connector is forced out; the user moreover has control over the correct carrying out of the process of insertion.

Figure 3:
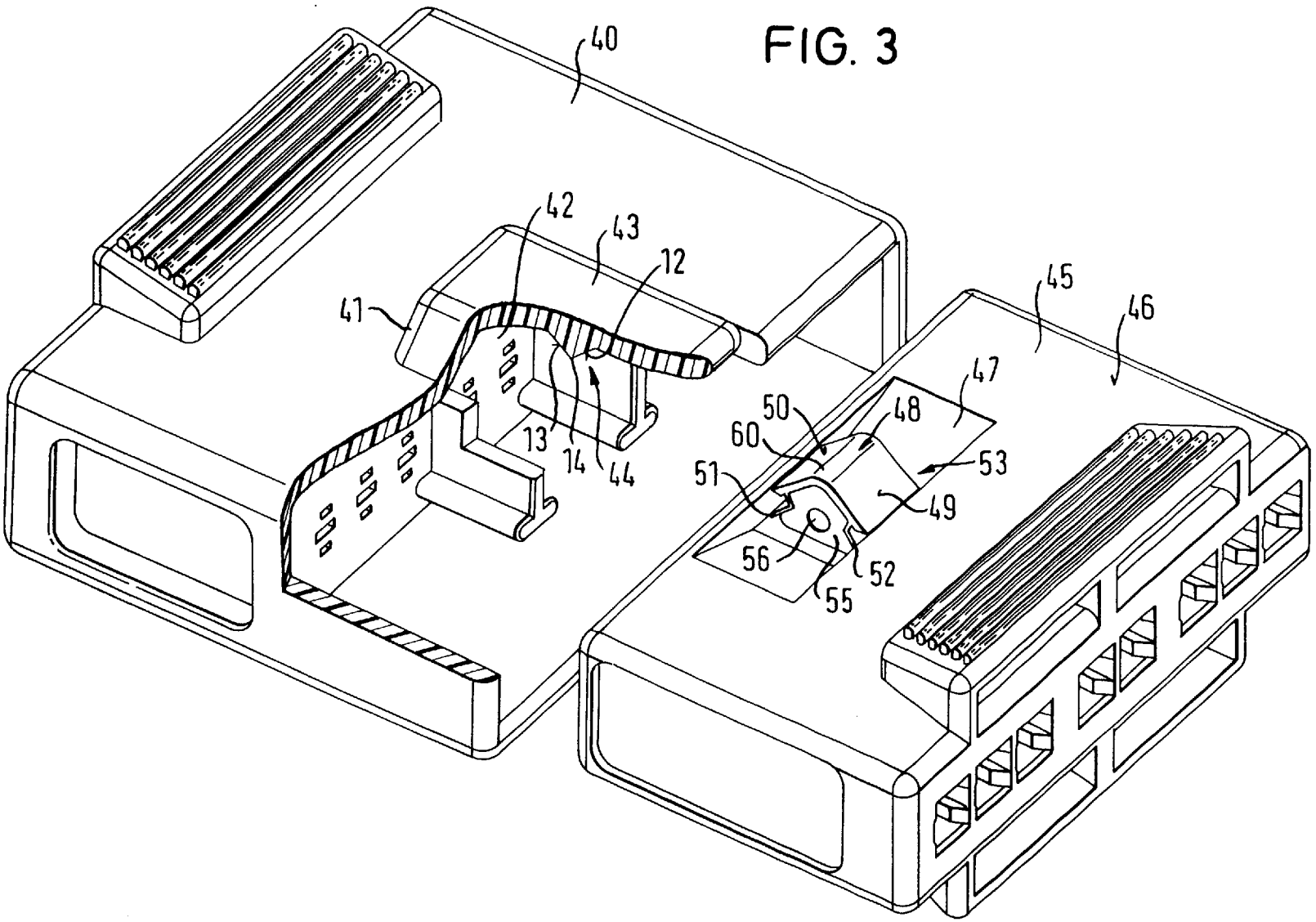
FIG. 3 is a perspective view of a second embodiment example of a connector plug with its pin socket shown partly cut away.
Figure 4A:
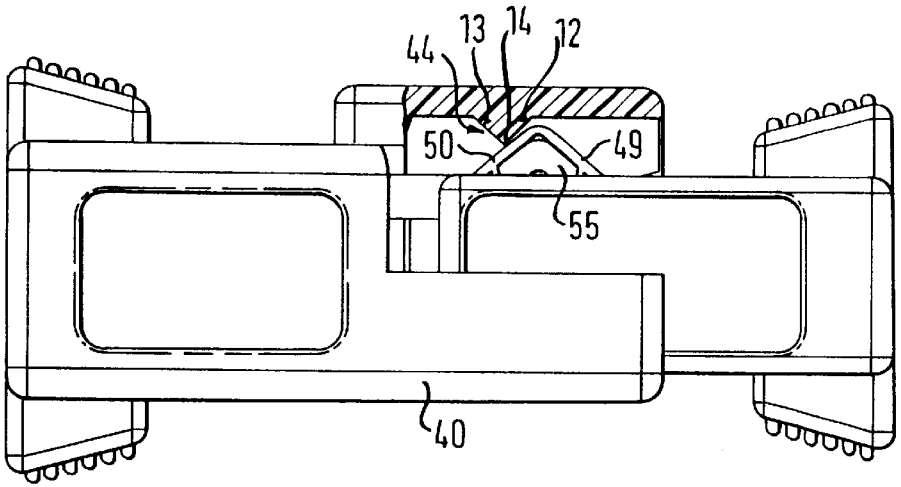
FIG. 4A is a side view of a part-section of the connector plug from FIG. 3 in its half-inserted position
Figure 4B:
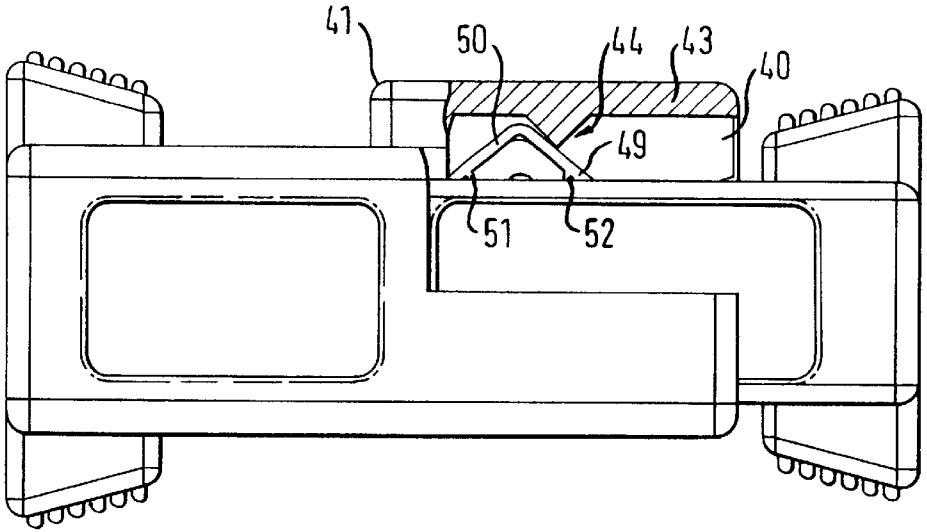
FIG. 4B is a side view of a part-section of the connector plug from FIG. 3 in its fully inserted position

The second embodiment example is described in FIGS. 3 to 4B. For simplicity, only the differences between the two embodiment examples are explained.

The connector 40 which is also rectangular in shape, also has a trapezoidal projection 41 which surrounds a recess 42. On the cover 43 of the projection 41, an inward-facing locking lug 44 is formed-on and is framed by two diagonal ramps 13, 14, which meet in a ridge 14. This locking lug 44 forms the first locking element.

The counter-connector 45 which is also rectangular in shape, has on its upper face 46 an indentation 47 in which a second locking element 53 is formed-on. This house-shaped element has a gable roof 48 with two slopes 49, 50 and two walls 51, 52 which lie opposite one another and are buckled inwards with the complementarily formed spring element 55 located in the thus formed hollow space. Preferably, the wall thickness is lower than the thickness of the roof. A pass-through hole 56 is in the centre of the spring element 55.

In inserting the counter-connector into the connector, the ramp 12 acts on the slope 50 of the roof 48 which is pressed downwards, causing the walls 51 to reach deeper into the hollow space and the spring element 55 is flattened. A tension builds up and if the user presses harder on the counter-connector so that the tip 60 of the roof 48 overcomes the ridge 14 of the locking lug 44, the tension which has built up in the spring element is released, so that the counter-connector is automatically forced into the connector. In the case of incomplete insertion, the counter-connector is forced out again in the same manner as that explained in the case of the first embodiment example.

It should be observed that in both embodiment examples with the help of locking lugs and the second locking element (more concretely, with the tips 31 of the angles or the tips 60 of the roof) a swell point is defined which must be overcome during insertion or withdrawal, in order to perform the insertion or withdrawal procedure correctly.

The general difference between the two embodiment examples according to FIG. 1 to FIG. 2B and FIG. 3 to FIG. 4B is that in the first embodiment example, the spring element is stretched and in the second embodiment example, it is compressed.

The connector housing with stiff lugs should preferably be relatively stable, in order not to influence the spring properties of the complete connector system.

What is claimed is:

1. An electrical connector plug comprising:

a connector housing having at least a first locking element that is rigid, a counter-connector housing complementary to the connector housing, the counter connector housing having at least a second locking device that is elastic, the counter connector housing also having a spring element adapted to increase the spring force and back up the elastic resilient second locking device, wherein the spring element is molded along with the counter-connector housing thereby forming a single piece combined housing and spring element in which the elasticity of the spring element is self-adjustable, the two locking elements defining an unstable swell point; and during the movement of the counter-connector housing in the direction of insertion into the connector housing, the first locking element acts on the second locking element whereby the spring element located in the second locking element builds up a tension with the swell point being determined by the use of the spring element.

2. An electrical connector plug according to claim 1, wherein said first locking element has at least one locking lug directed to at least one of said second locking elements, the lug being formed by two diagonal ramps which meet in a ridge.

3. An electrical connector plug according to claim 1, wherein said spring element consists of a rubber or an elastomer material.

4. An electrical connector plug according to claim 1, wherein said spring elements includes a pass-through hole located substantially in the center and that the elasticity of the spring element is adjustable by changing the diameter of the hole.

5. An electrical connector plug according to claim 1, wherein said second locking element is house-shaped with a gable roof and two buckled walls arranged opposite one another with a complementarily formed spring element located in a hollow space formed by the walls.

6. An electrical connector plug according to claim 1, wherein said second locking element has two angles, each with two legs which are coupled in pairs at one of their corresponding ends and that said spring element connecting the ends with one another as the common base of the two angles.

7. An electrical connector plug according to claim 6, wherein said ends of said substantially long spring element is rosette-shaped with the ends of said angles have corresponding seats for fastening said spring elements into them.

8. An electrical connector plug according to claim 6, where tips of said angles and said pass-through hole are arranged in a substantially vertical direction to said direction of insertion, with a pin formed on said counter-connector housing and directed outwards located in said hole and the fact that the connector housing has on its inner wall two first locking elements lying opposite one another.

9. An electrical connector plug according to claim 6, wherein ridges of locking lugs and the tips of said angles jointly define the swell point.

* * * * *